United States Patent [19]

Scarola

[11] 3,996,638

[45] Dec. 14, 1976

[54] MOP HOLDER HAVING SLIDEABLE JAW

[76] Inventor: Leonard J. Scarola, 1252 E. 53rd St., Brooklyn, N.Y. 11234

[22] Filed: Aug. 1, 1975

[21] Appl. No.: 601,151

[52] U.S. Cl. ..... 15/151; 15/153

[51] Int. Cl.[2] ..... A47L 13/24

[58] Field of Search ..... 15/115, 116 A, 119 A, 15/148, 150–153, 173, 228, 229 R, 229 A, 229 AW

[56] References Cited

UNITED STATES PATENTS

| | | | |
|---|---|---|---|
| 44,832 | 10/1864 | Bullen | 15/153 |
| 704,483 | 7/1902 | Mansfield | 15/178 |
| 979,834 | 12/1910 | Ean | 15/153 |
| 1,223,464 | 4/1917 | Andersch et al. | 15/153 |
| 3,447,183 | 6/1969 | McClung et al. | 15/151 |

FOREIGN PATENTS OR APPLICATIONS

| | | | |
|---|---|---|---|
| 901,517 | 11/1944 | France | 15/244 R |
| 297,825 | 5/1917 | Germany | 15/148 |
| 664,440 | 1/1952 | United Kingdom | 15/119 |
| 292,760 | 6/1928 | United Kingdom | 15/147 A |

*Primary Examiner*—Daniel Blum

[57] ABSTRACT

A sturdy mop mounting base having an elongated upper handle-receivable portion and lower face spaced-apart anchoring receptacles, with length thereof along an axis extending in alignment with the two receptacles being shorter than the width of a mop to be secured against that lower face, and a separate clamping element of a substantially U-shape having the legs thereof positioned to be anchored within the spaced-apart anchoring receptacles.

1 Claim, 6 Drawing Figures

MOP HOLDER HAVING SLIDEABLE JAW

This invention relates to a novel durable mop having novel advantages.

BACKGROUND TO THE INVENTION

Prior to the present invention, there have, particularly for commercial mops, been mops of many varying design, but none of which are adequately characterized by durable handle-receiving structure, nor with securely held and anchored mops to the support structure, nor by structure susceptable to mopping easily and adequately in corners and/or near office equipement or furniture, nor to make best use of the mopping stroke of the worker for improved ease and effectiveness.

SUMMARY OF THE INVENTION

Accordingly, objects of the present invention include the overcoming of difficulties and disadvantages of the types described above.

Another object is to obtain a novel low-cost mop clamp having advantages of the types overcoming such problems.

Another object is a novel combination of low cost and sturdy structures designed in a novel configuration and with elements susceptable to obtaining great sturdiness and stability of support of a mop.

Another object is to provide a mop support having edges that do not extend the width of the mop while concurrently providing a full degree of support, making for less likelihood of scarring or striking of furniture or equipment during a mopping operation.

Another object is to obtain a slant on the underface of the mop support structure such that improved ease of mopping stroke is obtained, and such as to obtain a greater power stroke and a stroke of improved efficiency in its cleansing action.

Other objects become apparent from the preceding and following disclosure.

One or more objects of the invention are obtained by the invention as defined herein.

Broadly the invention may be defined as a mop combination and novel elements thereof, in which the handle and mop support base is characterized by an elongated bottom face preferably angled upwardly from forward to rearward edge, of a predetermined elongated length less than that of a mop to be clamped thereon, having anchoring holes spaced-apart adjacent opposite ends of the elongated bottom face, and having a substantially U-shaped clamping element in one part or in a base-clamp part with anchoring screws alternately, with the anchoring legs (or screws) being receivable within the spaced-apart holes typically anchorable on a top surface through which the legs (or screws) may optionally extend. It is the spaced-apart anchoring of the clamped mop, together with the broadened and extended handle-receiving upper portion of the mop support base, as well as the shortened elongated length of the mop-receiving lower surface that provides the individual and multiple advantages of the invention, ralative to the width of mop to be utilized with the mop base support, and as contrasted to prior mop structures normally susceptable to having the handle break-out of the support after less than a satisfactory period of use. Also, normally and always heretofore, there has been no provision made for the fact that the mop is on a slant when the mopping stroke occurs; with the present invention, the angled bottom face of the mop base support provides for the bottom surface to be substantially parallel with the floor surface at the time of the stroke and during the stroke, such that there is an even downward pressure over an area comparable to the entire surface of the lower face of the mop support structure. Heretofore, there has been no such provision, with the result that solely a rearward edge of the base support structure forms a pressure line on the clamped mop. Also, such concentrated prior force served to accentuate pressure and force lines through the structure of the mop support — thereby contributing to the breaking of the handle-receiving structure of the mop support base with the shearing of the handle therefrom thereby.

The invention may be better understood by making reference to the following Figures.

THE FIGURES

DETAILED DESCRIPTION OF THE INVENTION

Figure 1:
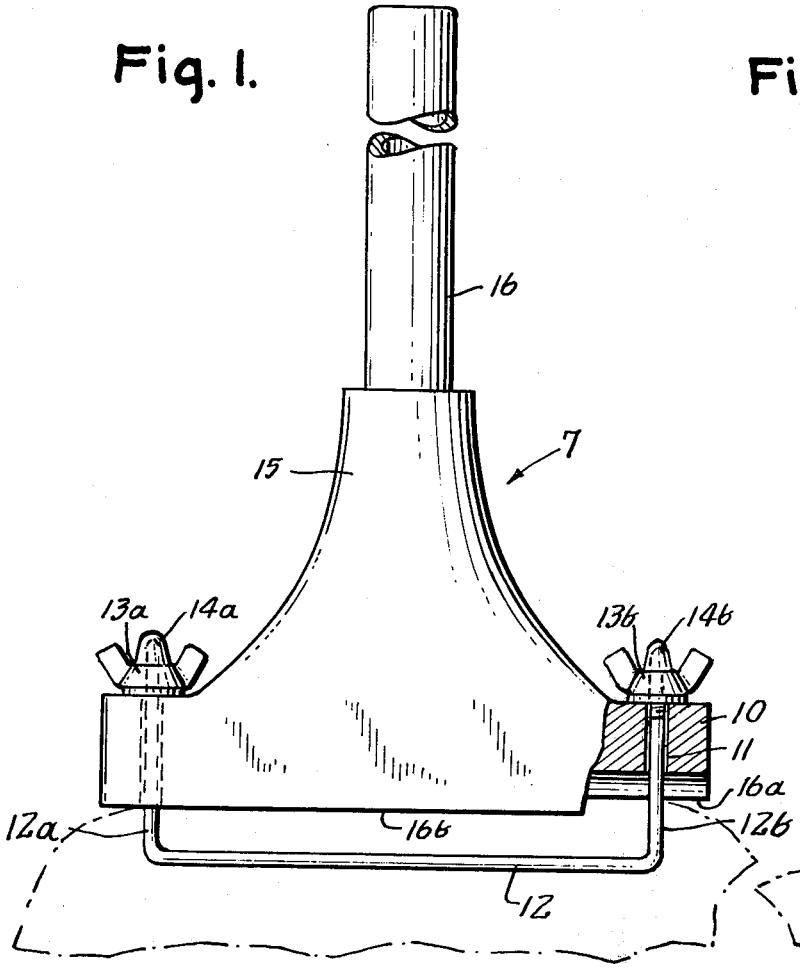
FIG. 1 illustrates a side elevation view with partial cut-away for improved illustration, of the novel mop base structure and the U-shaped structure in one embodiment thereof, including capped wing-nuts to prevent the possibility of scarring and for safety.
Figure 2:
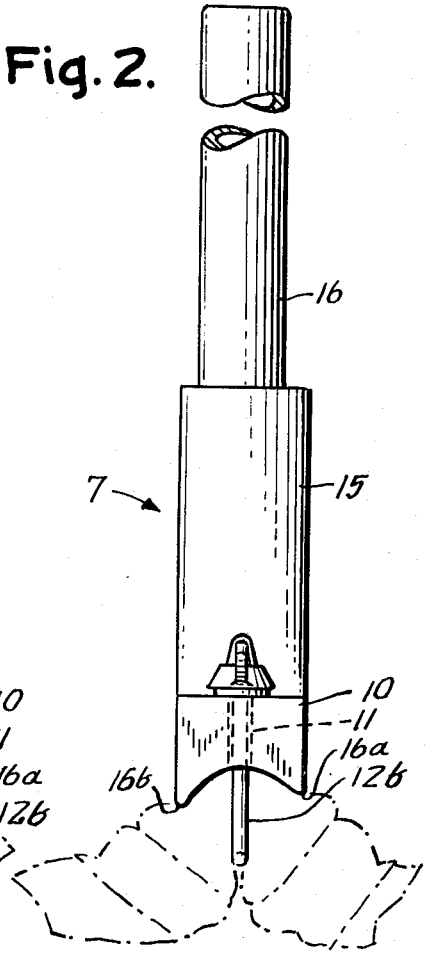
FIG. 2 illustrates an end elevation view of the embodiment of FIG. 1.
Figure 5:
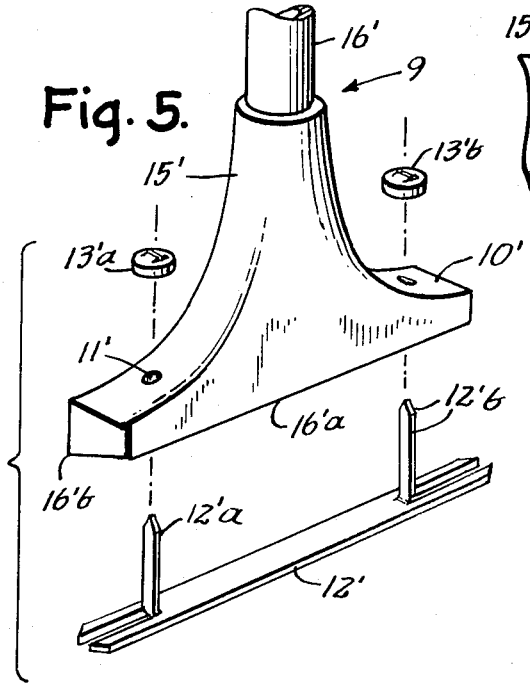
FIG. 5 illustrates a still other alternate and preferred embodiment of the invention, in which the anchoring legs are upwardly bent flange projections cut from pointed ends of the precut strip, providing for sharp piercing points of the legs, shown in side perspective exploded view, with anchoring clamps for the respective legs.
Figure 3:
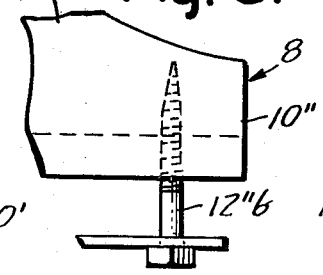
FIG. 3 illustrates an in-part view in elevation plan for an alternate embodiment of the invention, in a side view thereof.
Figure 4:
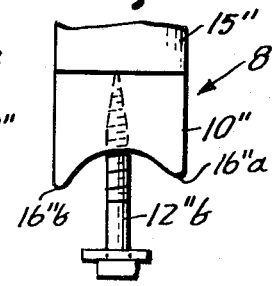
FIG. 4 illustrates an end elevation view of the embodiment of FIG. 3.
Figure 6:
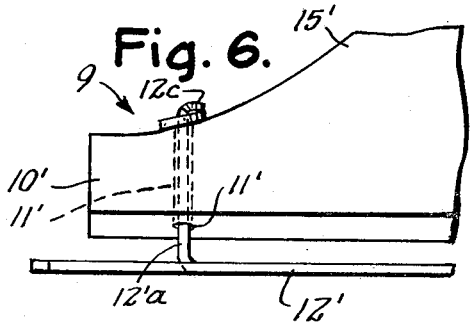
FIG. 6 illustrates in an in-part view, the embodiment of FIG. 5, in a side elevation view, in the mounted or anchored state of being, typically.

In greater detail, FIGS. 1 and 2 illustrate a mop device combination 7, FIGS. 3 and 4 another embodiment 8 and FIGS. 5 and 6 a third embodiment 9. The equivalent parts of the three embodiments illustrated are identified by corresponding numerals, as the FIGS. 5 and 6 embodiment 9 having mop base support structure 10′ as comparable to the FIGS. 1 and 2 base support structure 10, and the FIGS. 3 and 4 structures 10″, and similarly for other elements identified, as for example the FIGS. 1 and 2 having additional elements as hole (aperture) 11, and the U-shaped clamp structure 12 with the anchoring legs 12*a* and 12*b*, and their respective wing-nut caps 13*a* and 13*b* with the caps 14*a* and 14*b* thereof.

In the FIGS. 3 and 4 embodiment, the hole 11″ does not extend through the entire structure thickness of the structure 15″ which is the upper structure of the mop base support structure. Instead, it merely has the bolt 12″b threadedly screwed upwardly thereinto, which bolt would extend through a punctured mop strip.

In the FIGS. 5 and 6 embodiment 9, the legs 12′*a* and 12′*b* represent upwardly bent mop-piercing anchoring elements, as cut-out flanges from the main strip 12′ having an upper flat bore. After insertion through the holes 11′, the ends thereof 12*c* are bent-over after having been first inserted through the lock washer elements 13'a and 13'b.

The upwardly extending handle support structure 15 and 15' and 15'' extend predetermined large distances upwardly with typically illustrated thickness to give the desired greater strength against breaking during strenuous use of the mop.

With regard to the FIGS. 1 and 2 embodiment, for best illustration, it should be noted that the leading edge 16b is lower than trailing edge 16a, as is FIGS. 5 and 6 embodiment leading edge 16'b as compared to trailing edge 16'a, and the FIGS. 3 and 4 edges 16''a and 16''b. Accordingly, when mopping, moving the mop to and fro, the front edge will be substantially the same distance from the floor as the trailing edge because the mop handle is held angularly by the mopping person. The lower or seating face of the support structure 10' (FIGS. 5,6) is inclined and flat.

It is to be understood that the present invention includes modifications and alterations and substitution of equivalents as would be apparent to a person of ordinary skill in this field.

I claim:

1. A mop holder comprising a mop clamping means for detachably clamping and securing a mop and for detachably receiving a handle, including a base support structure defining an elongated lineally-extending handle receptacle of predetermined long length, and having a substantially flat inclined lower seating face having a length extending laterally in opposite directions along a linear path substantailly horizontally transversely to a longitudinal axis of the elongated handle receptacle and defining at least two spaced-apart anchoring apertures in the seating face, and the flat lower seating face having leading and trailing edges, the leading edge being a predtermined distance lower than the trailing edge relative to said longitudinal axis; and anchoring structure including an elongated strip having a substantially flat upper face adjacent and opposite ends thereof integral spaced-apart anchoring projections bent upwardly the distal ends of the respective anchoring projections being pointed for piercing mop heads, said spaced apart apertures extending through upper surfaces of the base structue, a pair of lock washer elements, the washer elements being slidably lockable on the anchoring projections after the latter are inserted through the base apertures to secure the anchoring strip to the base support structure, the holder adapted to accommodate mop heads of various widths.

* * * * *